US011610540B2

(12) United States Patent
Piao et al.

(10) Patent No.: US 11,610,540 B2
(45) Date of Patent: Mar. 21, 2023

(54) DATA DRIVER, MULTI-CHANNEL SENSING CIRCUIT AND SENSING METHOD THEREOF

(71) Applicant: LX SEMICON CO., LTD., Daejeon (KR)

(72) Inventors: Taiming Piao, Daejeon (KR); Young Bok Kim, Daejeon (KR); Won Kim, Daejeon (KR); Byeon Cheol Lee, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/694,837

(22) Filed: Mar. 15, 2022

(65) Prior Publication Data

US 2022/0301495 A1 Sep. 22, 2022

(30) Foreign Application Priority Data

Mar. 22, 2021 (KR) ..... 10-2021-0036345

(51) Int. Cl.
*G09G 3/32* (2016.01)

(52) U.S. Cl.
CPC ..... *G09G 3/32* (2013.01); *G09G 2310/027* (2013.01); *G09G 2310/0291* (2013.01); *G09G 2310/0294* (2013.01); *G09G 2310/061* (2013.01)

(58) Field of Classification Search
None
See application file for complete search history.

(56) References Cited

U.S. PATENT DOCUMENTS

2018/0190207 A1* 7/2018 Hwang ..... G09G 3/3291
2020/0234636 A1* 7/2020 Lin ..... H03K 3/356113
2020/0357338 A1* 11/2020 Lee ..... G09G 3/3258

FOREIGN PATENT DOCUMENTS

KR 10-2018-0078700 A 7/2018
KR 10-2020-0072062 A 6/2020
KR 10-2020-0129471 A 11/2020

* cited by examiner

*Primary Examiner* — Chad M Dicke
(74) *Attorney, Agent, or Firm* — Harness, Dickey & Pierce, P.L.C.

(57) ABSTRACT

A data driver, a multi-channel sensing circuit and a sensing method thereof are provided. A multi-channel sensing circuit, where a configuration of a sample/hold circuit part is simplified to decrease a circuit area, and a sensing method of the multi-channel sensing circuit are provided. The multi-channel sensing circuit may include a first sample/hold circuit sampling and outputting a first sensing voltage, a second sample/hold circuit sampling and outputting a second sensing voltage, a share sample/hold circuit sampling and outputting a reference voltage, and an amplification part differential-amplifying the first sensing voltage output from the first sample/hold circuit and the reference voltage output from the share sample/hold circuit and differential-amplifying the second sensing voltage output from the second sample/hold circuit and the reference voltage output from the share sample/hold circuit.

18 Claims, 7 Drawing Sheets

DATA DRIVER, MULTI-CHANNEL SENSING CIRCUIT AND SENSING METHOD THEREOF

CROSS-REFERENCE TO RELATED APPLICATIONS

This application claims the benefit of the Korean Patent Application No. 10-2021-0036345 filed on Mar. 22, 2021, which is hereby incorporated by reference as if fully set forth herein.

FIELD

The present disclosure relates to a multi-channel sensing circuit, where a configuration of a sample/hold circuit part is simplified to decrease a circuit area, and a sensing method of the multi-channel sensing circuit.

BACKGROUND

Light emitting display apparatuses supply a current corresponding to a gray level to a light emitting device disposed in each subpixel to allow the light emitting device to emit light, and thus, displays an image. The light emitting display apparatuses realize high luminance, are driven with a low driving voltage, and are implemented to have an ultra-thin thickness and a free shape.

In the light emitting display apparatuses, a luminance deviation may occur due to an electrical characteristic deviation of each subpixel. In order to solve such a problem, the light emitting display apparatuses use an external compensation method which senses and compensates for an electrical characteristic of each subpixel.

A data driver integrated circuit (IC) includes a driving circuit part which drives data lines and a sensing circuit part which senses an electrical characteristic of each subpixel through sensing lines, for external compensation, and due to this, there is a limitation in reducing the manufacturing cost and an area of the data driver IC.

SUMMARY

Accordingly, the present disclosure is directed to providing a multi-channel sensing circuit and a sensing method thereof that substantially obviate one or more problems due to limitations and disadvantages of the related art.

An aspect of the present disclosure is directed to providing a multi-channel sensing circuit where a configuration of a sample/hold circuit part is simplified to decrease a circuit area, a sensing method of the multi-channel sensing circuit, and a data driver.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a multi-channel sensing circuit including a first sample/hold circuit sampling and outputting a first sensing voltage obtained by sensing a driving characteristic of a pixel connected to a first sensing channel, a second sample/hold circuit sampling and outputting a second sensing voltage obtained by sensing a driving characteristic of a pixel connected to a second sensing channel, a share sample/hold circuit sampling and outputting a reference voltage, and an amplification part differential-amplifying the first sensing voltage output from the first sample/hold circuit and the reference voltage output from the share sample/hold circuit and differential-amplifying the second sensing voltage output from the second sample/hold circuit and the reference voltage output from the share sample/hold circuit.

In the multi-channel sensing circuit according to an aspect of the present disclosure, the first sample/hold circuit may sample the first sensing voltage and the second sample/hold circuit samples the second sensing voltage during a sampling period, the share sample/hold circuit may sample the reference voltage during a first reset period after the sampling period, the first sample/hold circuit may output the first sensing voltage to the amplification part during a first holding/amplifying period after the first reset period, the share sample/hold circuit may output the reference voltage during a second reset period after the first holding/amplifying period, the second sample/hold circuit may output the second sensing voltage to the amplification part during a second holding/amplifying period after the second reset period, and the share sample/hold circuit may output the reference voltage to the amplification part during the first and second holding/amplifying periods.

In another aspect of the present disclosure, there is provided a data driver including a data driving part driving data lines and a multi-channel sensing circuit connected to sensing channels.

In another aspect of the present disclosure, there is provided a sensing method of a multi-channel sensing circuit, the sensing method including sampling and outputting a first sensing voltage obtained by sensing a driving characteristic of a pixel connected to a first sensing channel by using a first sample/hold circuit and sampling and outputting a second sensing voltage obtained by sensing a driving characteristic of a pixel connected to a second sensing channel by using a second sample/hold circuit, during a sampling period, sampling and outputting a reference voltage by using a share sample/hold circuit during a first reset period, differential-amplifying and outputting the first sensing voltage output from the first sample/hold circuit and the reference voltage output from the share sample/hold circuit by using an amplification part during a first holding/amplifying period, sampling and outputting the reference voltage by using the share sample/hold circuit during a second reset period, and differential-amplifying and outputting the second sensing voltage output from the second sample/hold circuit and the reference voltage output from the share sample/hold circuit by using the amplification part during a second holding/amplifying period.

The sensing method of the multi-channel sensing circuit according to an aspect of the present disclosure may further include converting an output of the amplification part into digital sensing data and outputting the digital sensing data by using an analog-to-digital converter during the first and second holding/amplifying periods.

The sensing method of the multi-channel sensing circuit according to an aspect of the present disclosure may further include resetting an input terminal and an output terminal of the amplification part and a feedback capacitor connected between the input terminal and the output terminal during the first and second reset periods.

The sensing method of the multi-channel sensing circuit according to an aspect of the present disclosure may further include a reset period which overlaps the sampling period and where the share sample/hold circuit samples the reference voltage and the amplification part is reset.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
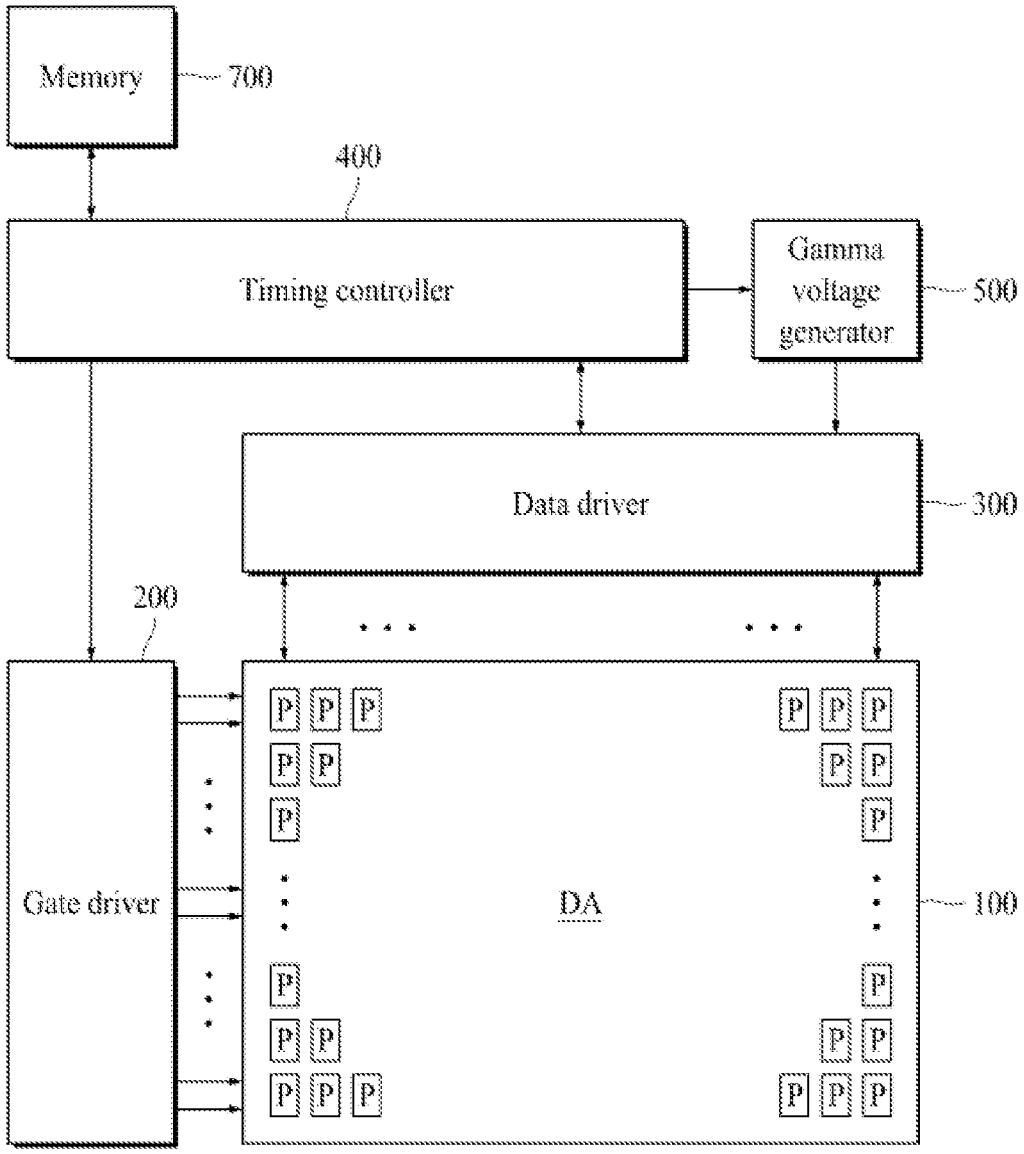
FIG. 1 is a block diagram illustrating a configuration of a display apparatus according to an embodiment.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as "on," "over," "under," and "next," one or more other parts may be disposed between the two parts unless a more limiting term, such as "just" or "direct(ly)" is used.

In describing a time relationship, for example, when the temporal order is described as, for example, "after," "subsequent," "next," and "before," a case which is not continuous may be included unless a more limiting term, such as "just," "immediate(ly)," or "direct(ly)" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, the terms "first," "second," "A," "B," "(a)," "(b)," etc., may be used. These terms are intended to identify the corresponding elements from the other elements, and basis, order, or number of the corresponding elements should not be limited by these terms. The expression that an element is "connected," "coupled," or "adhered" to another element or layer, the element or layer can not only be directly connected or adhered to another element or layer, but also be indirectly connected or adhered to another element or layer with one or more intervening elements or layers "disposed" between the elements or layers, unless otherwise specified.

The term "at least one" should be understood as including any and all combinations of one or more among the associated listed elements. For example, the meaning of "at least one or more of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings. For convenience of description, a scale of each of elements illustrated in the accompanying drawings differs from a real scale, and thus, is not limited to a scale illustrated in the drawings.

Figure 2:
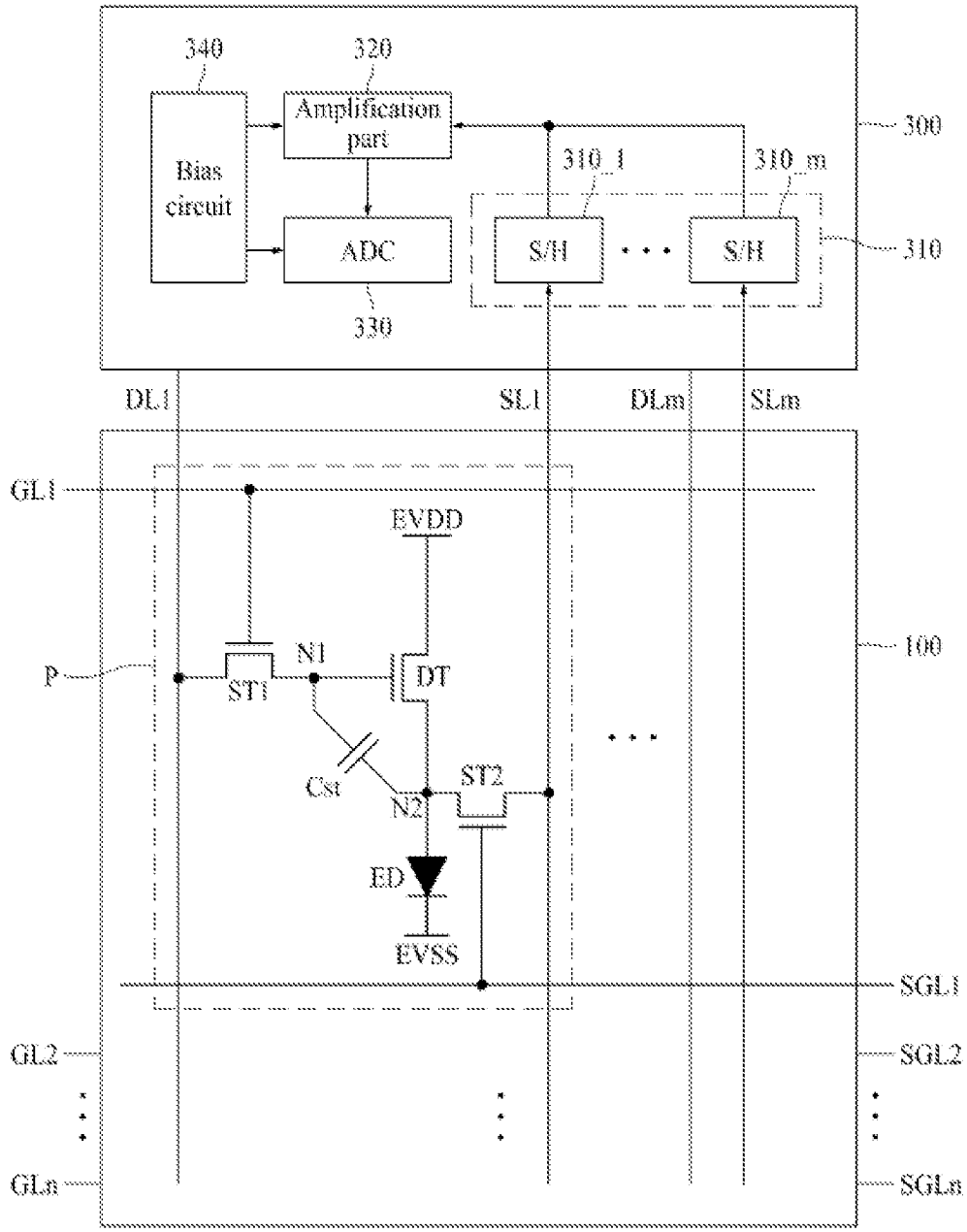
FIG. 2 is a circuit diagram illustrating one pixel circuit and a sensing circuit of a data driver according to an embodiment.

FIG. 1 is a block diagram illustrating a configuration of a display apparatus according to an embodiment, and FIG. 2 is a circuit diagram illustrating one pixel circuit and a sensing circuit of a data driver according to an embodiment.

An example of the display apparatus according to an embodiment may include an electroluminescent display apparatus. An example of the electroluminescent display apparatus may include an organic light emitting diode (OLED) display apparatus, a quantum-dot light emitting diode display apparatus, and an inorganic light emitting diode display apparatus.

Referring to FIGS. 1 and 2, the display apparatus may include a panel 100, a gate driver 200, a data driver 300, a timing controller 400, a gamma voltage generator 500, and a memory 700. The gate driver 200 and the data driver 300 may be defined as a panel driver which drives the panel 100. The gate driver 200, the data driver 300, the timing controller 400, and the gamma voltage generator 500 may be defined as a display driver.

The panel 100 may display an image through a display area DA corresponding to a pixel array area where a plurality of subpixels P are arranged as a matrix type. A basic unit pixel may include three or four color subpixels or two color subpixels among a red subpixel which emits red light, a green subpixel which emits green light, a blue subpixel which emits blue light, and a white subpixel which emits white light.

Each of the subpixels P may include a light emitting device and a pixel circuit which independently drives the light emitting device. The light emitting device may include an OLED, a quantum-dot light emitting diode, or an inorganic light emitting diode. The pixel circuit may include a plurality of thin film transistors (TFTs), including a driving TFT which drives the light emitting device and a switching TFT which supplies a data signal to the driving TFT, and a storage capacitor which stores a driving voltage Vgs corresponding to the data signal supplied through the switching TFT and supplies the driving voltage Vgs to the driving TFT. In addition, the pixel circuit may further include a plurality of TFTs which initialize each of three electrodes (a gate, a source, and a drain) of the driving TFT, connect the driving TFT in a diode structure so as to compensate for a threshold voltage, or control an emission time of the light emitting device. A configuration of the pixel circuit may include various configurations such as 3T1C (three TFTs and one capacitor) and 7T1C (seven TFTs and one capacitor).

For example, as illustrated in FIG. 2, each subpixel P may include a light emitting device ED, which is connected to a high level source voltage (a first source voltage) EVDD line and a low level source voltage (a second source voltage) EVSS line, and a pixel circuit which includes first and second switching TFTs ST1 and ST2, a driving TFT DT, and a storage capacitor Cst so as to independently drive the light emitting device ED.

The light emitting device ED may include an anode connected to a source node N2 of the driving TFT DT, a cathode connected to the EVSS line, and a light emitting layer between the anode and the cathode. The anode may be independent for each subpixel, and the cathode may be a common electrode shared by all subpixels. In the light emitting device ED, when a driving current is supplied from the driving TFT DT, an electron injected into the light emitting layer from the cathode and a hole injected into the light emitting layer from the anode may be combined to generate an exciton, and the generated exciton may be shifted from an excited state to a ground state to allow a fluorescent or phosphorous material to emit light, thereby emitting light having brightness proportional to a current value of the driving current. A light emitting material may include an organic material, or may include an inorganic material such a quantum dot.

The first switching TFT ST1 may be driven by a first gate pulse supplied through a first gate line GLi (where i is an integer which is one of 1 to n) from the gate driver 200 and may transfer a data voltage, supplied through a data line DLj (where j is an integer which is one of 1 to m) from the data driver 300, to a gate node N2 of the driving TFT DT.

The second switching TFT ST2 may be driven by a second gate pulse supplied through a first gate line SGLi (where i is an integer which is one of 1 to n) from the gate driver 200 and may transfer a reference voltage, supplied through a sensing line SLj (where j is an integer which is one of 1 to m) from the data driver 300, to a source node N2 of the driving TFT DT. In a sensing mode, the second switching TFT ST2 may transfer a current, in which a characteristic of the driving TFT DT or a characteristic of the light emitting device ED is reflected, to the sensing line SLj.

The first and second switching TFTs ST1 and ST2, as in FIG. 2, may be controlled by different gate lines GLi and SGLi, or may be controlled by the same gate line.

The storage capacitor Cst connected between the gate node N1 and the source node N2 of the driving TFT DT may be charged with a difference voltage between the data voltage and the reference voltage, respectively supplied to the gate node N1 and the source node N2 through the first and second switching TFTs ST1 and ST2, as the driving voltage Vgs of the driving TFT DT and may hold the charged driving voltage Vgs during an emission period where the first and second switching TFTs ST1 and ST2 are turned off.

The driving TFT DT may control a current supplied through the EVDD line on the basis of the driving voltage Vgs supplied from the capacitor Cst to transfer the driving current, defined based on the driving voltage Vgs, to the light emitting device ED to allow the light emitting device ED to emit light.

The gate driver 200 may be controlled based on a plurality of gate control signals supplied from the timing controller 400 and may individually drive gate lines of the panel 100. The gate driver 200 may supply a pulse signal of a gate-on voltage to a corresponding gate line in a driving period of each of the gate lines GLi and SGLi and may supply a gate-off voltage to a corresponding gate line in a non-driving period of each of the gate lines GLi and SGLi.

The gamma voltage generator 500 may generate a plurality of reference gamma voltages having different voltage levels and may supply the reference gamma voltages to the data driver 300. The gamma voltage generator 500 may generate the plurality of reference gamma voltages corresponding to a gamma characteristic of the display apparatus and may supply the plurality of reference gamma voltages to the data driver 300, on the basis of control by the timing controller 400. The gamma voltage generator 500 may adjust a reference gamma voltage level on the basis of gamma data supplied from the timing controller 400 and may output a level-adjusted reference gamma voltage to the data driver 300.

The data driver 300 may be controlled based on a data control signal supplied from the timing controller 400, and moreover, may convert digital data, supplied from the timing controller 400, into an analog data signal by using a digital-to-analog converter (DAC) and may supply a corresponding data signal to each data line DLj of the panel 100. At this time, the data driver 300 may convert the digital data into the analog data signal by using grayscale voltages obtained by subdividing the plurality of reference gamma voltages supplied from the gamma voltage generator 500.

The data driver 300 may supply a reference voltage to the sensing line SLj of the panel 100 on the basis of control by the timing controller 400. The data driver 300 may divide the reference voltage into a display reference voltage and a sensing reference voltage and may supply the display reference voltage and the sensing reference voltage, on the basis of control by the timing controller 400.

The data driver 300 may sense a signal representing a driving characteristic of each subpixel through each sensing line SLj by using a sensing part according to control by the timing controller 400, on the basis of a voltage sensing scheme or a current sensing scheme and may convert the sensed signal to sensing data by using an analog-to-digital converter (ADC) to supply the sensing data to the timing controller 400.

The timing controller 400 may control the gate driver 200 and the data driver 300 by using timing setting information stored therein and timing control signals supplied from a host system. The host system may be one of a computer, a television (TV) system, a set-top box, and a system of a portable terminal such as a tablet computer or a portable phone. The timing control signals may include a dot clock, a data enable signal, a vertical synchronization signal, and a horizontal synchronization signal.

The timing controller 400 may generate a plurality of gate control signals for controlling a driving timing of the gate driver 200 and may supply the gate control signals to the gate driver 200. The timing controller 400 may generate a plurality of data control signals for controlling a driving timing of the data driver 300 and may supply the data control signals to the data driver 300.

The timing controller 400 may perform various image processing on video data supplied from the host system and may output image-processed data to the data driver 300. The timing controller 400 may perform various image processing for enhancing image quality on the video data and may analyze the video data to control peak luminance, thereby decreasing power consumption.

The timing controller 400 may perform compensation processing, such as characteristic deviation compensation and degradation (afterimage) compensation of each subpixel P, on video data of each subpixel P.

For example, the timing controller 400 may control the gate driver 200 and the data driver 300 to drive the panel 100 in the sensing mode and may sense, through the data driver 300, a threshold voltage Vth of the driving TFT DT in which a degradation or a characteristic deviation of each pixel P of the panel 100 is reflected, a mobility of the driving TFT DT, and the degree of degradation (a threshold voltage) of the light emitting device ED. The timing controller 400 may generate compensation data (Vth compensation data, mobility compensation data, and degradation compensation data) of each subpixel P on the basis of a sensing result and may store the generated compensation data in the memory 700. The timing controller 400 may apply the compensation data of each subpixel P stored in the memory 700 to compensate for the video data of each subpixel P, and thus, may perform compensation processing for compensating for a degradation and a characteristic deviation of each pixel P.

The sensing mode of the display apparatus may be performed based on control by the host system, performed based on a user request received through the host system, or performed based on a driving sequence of the timing controller 400.

Referring to FIG. 2, the data driver 300 may include a multi-channel sensing circuit which senses a pixel current in which a driving characteristic of each subpixel P (for example, a threshold voltage Vth of the driving TFT DT, a mobility of the driving TFT DT, or the degree of degradation (the threshold voltage) of the light emitting device ED) is reflected, on the basis of the voltage sensing scheme.

The data driver 300 may further include a sample and hold (S/H) circuit part 310 which includes a plurality of multi-channel S/H circuits 310_1 to **310_*m* respectively connected to a plurality of sensing lines SL1 to SLm of the panel 100, an amplification part 320 connected to the S/H circuit part 310 in common, and an ADC 330 connected to the amplification part 320. The data driver 300 may further include a bias circuit 340 which provides bias voltages to the S/H circuit part 310, the amplification part 320, and the ADC 330**.

The data driver 300 may convert sensing data, supplied from the timing controller 400, into a data voltage, supply the data voltage to each data line DLj (where j=1 to m), and supply a sensing reference voltage to each sensing line SLj (where j=1 to m). In a subpixel P selected by the gate lines GLi and SGLi (where i=1 to n) driven by the gate driver 200, the driving TFT DT may be driven by a sensing data voltage supplied through the first switching TFT ST1 and the sensing reference voltage supplied through the second switching TFT ST2 and may transfer a current to the light emitting device ED. A current in which an electrical characteristic (a threshold voltage and mobility) of the driving TFT DT or a degradation characteristic (a threshold voltage) of the light emitting device ED is reflected may be provided through the second switching TFT ST2 and may be charged into a line capacitor of the sensing line SLj which is in a floating state.

The multi-channel sensing circuit of the data driver 300 may be supplied with a sensing voltage of each subpixel P charged in each of the plurality of sensing lines SL1 to SLm, sample the sensing voltage simultaneously by using the plurality of multi-channel S/H circuits 310_1 to **310_*m*, store the sampled sensing voltage, provide a plurality of multi-channel sensing voltages to the amplification part 320 through sequential holding operations, amplify the multi-channel sensing voltages by using the amplification part 320, convert the amplified multi-channel sensing voltages into sensing data by using the ADC 330, and provide the sensing data to the timing controller 400**.

The S/H circuit part 310 according to an embodiment may include, as a single-structure sensing channel, the plurality of multi-channel S/H circuits 310_1 to **310_*m* which respectively sample the sensing voltages supplied through the plurality of sensing lines SL1 to SLm and sequentially supply the sampled sensing voltages and may include, as a single-structure share channel, an S/H circuit DMY (see FIG. 3) which repeats a sampling and holding operation on the reference voltage. The plurality of sensing-channel S/H circuits 310_1 to 310_*m* may supply the reference voltage to a second input terminal of the share-channel S/H circuit DMY (see FIG. 3) at every holding period where the sensing voltage is sequentially supplied to a first input terminal of the amplification part 320, and thus, may sequentially supply a difference voltage between each sensing voltage and the reference voltage to the amplification part 320**. This will be described below in detail.

Therefore, comparing with a configuration of 2 m number of S/H circuits of the related art where a pair of S/H circuits for a differential structure are provided for each channel, the S/H circuit part 310 according to an embodiment may include m+1 number of S/H circuits, thereby decreasing the number of S/H circuits. Accordingly, in an embodiment, a circuit configuration and area of the S/H circuit part 310 occupying the most of an area of the multi-channel sensing circuit may be reduced, and thus, a circuit configuration and area of the data driver 300 may decrease, thereby reducing the manufacturing cost.

Figure 3:
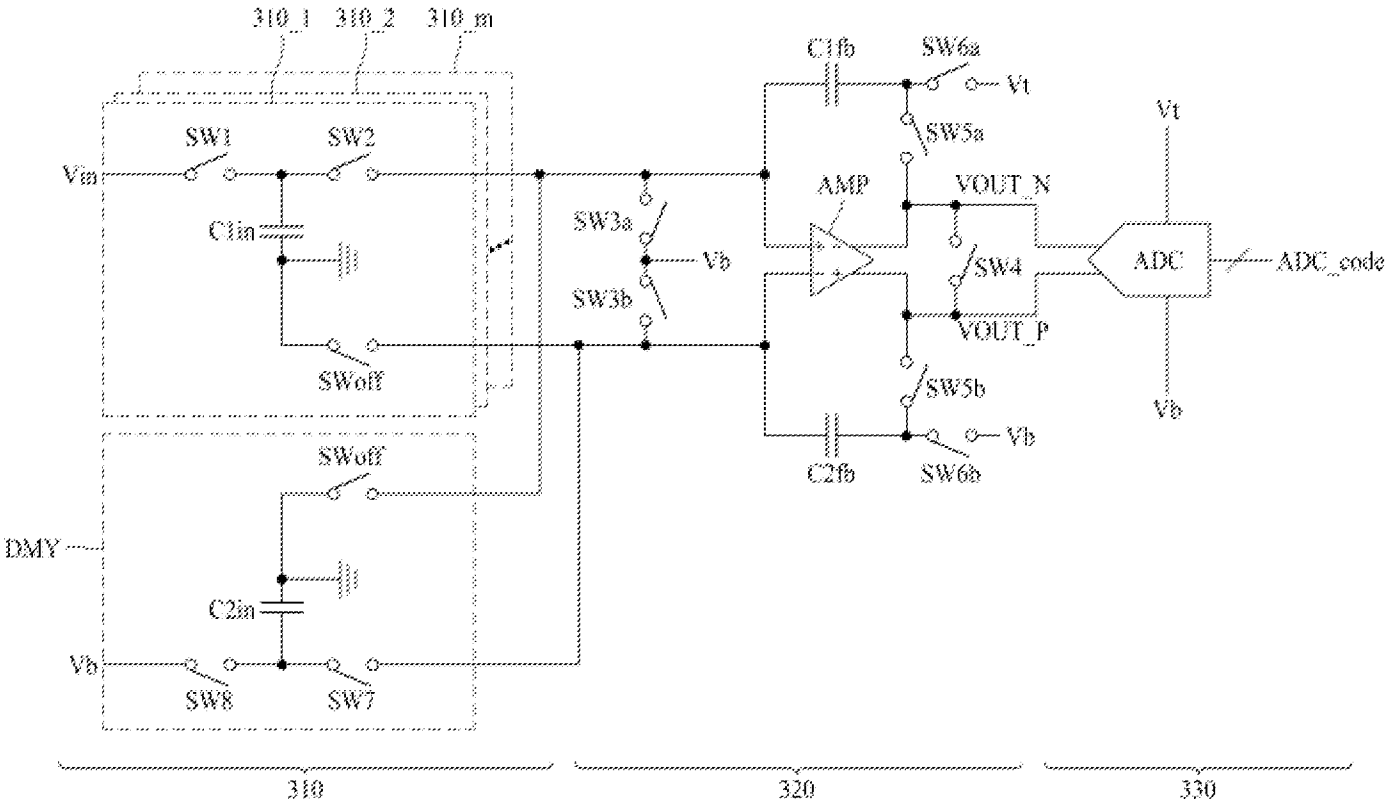
FIG. 3 is an equivalent circuit diagram illustrating a configuration of a multi-channel sensing circuit according to an embodiment.
Figure 4:
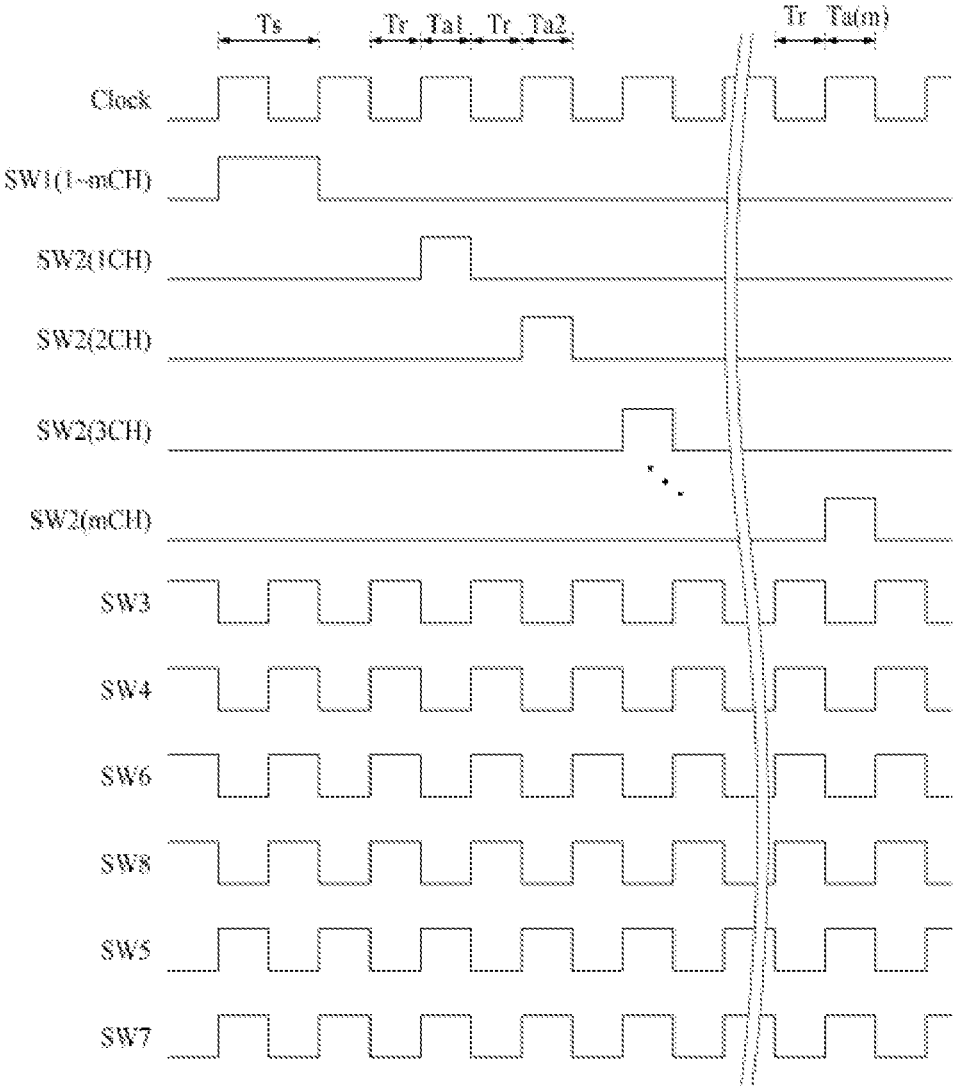
FIG. 4 is a driving waveform diagram of a multi-channel sensing circuit according to an embodiment illustrated in FIG. 3.

FIG. 3 is an equivalent circuit diagram illustrating a configuration of a multi-channel sensing circuit in a data driver 300 according to an embodiment, and FIG. 4 is a driving waveform diagram of the multi-channel sensing circuit according to an embodiment illustrated in FIG. 3.

Referring to FIG. 3, the multi-channel sensing circuit of the data driver 300 according to an embodiment may include a sample and hold (hereinafter referred to as sample/hold) circuit part 310, an amplification part 320, and an ADC 330.

The sample and hold (hereinafter referred to as sample/hold) circuit part 310, the amplification part 320, and the ADC 330 may be supplied with bias voltages Vb and Vt from the bias circuit 340 illustrated in FIG. 2. The bias voltages Vb and Vt may determine a voltage range of the ADC 330. The bias voltage Vt may denote a maximum voltage provided to the ADC 330, and the bias voltage Vb may denote a minimum voltage provided to the ADC 330 and may be defined as a reference voltage.

The sample/hold circuit part 310 may include a plurality of sensing-channel sample/hold circuits 310_1 to **310_*m* respectively connected to a plurality of input lines and a share-channel sample/hold circuit DMY connected to a supply line for the reference voltage Vb. The plurality of sensing-channel sample/hold circuits 310_1 to 310_*m* may be respectively connected to, through the plurality of input lines, the plurality of sensing lines SL1 to SLm of the panel 100 illustrated in FIG. 2**.

Each of the plurality of sensing-channel sample/hold circuits 310_1 to **310_*m* may include a sampling switch SW1 and a holding switch SW2, connected serially between each input line and a first input terminal (+) of the amplification part 320, and a sampling capacitor C1***in* connected between a ground terminal and a connection node between the sampling switch SW1 and the holding switch SW2.

In the plurality of sensing-channel sample/hold circuits 310_1 to **310_*m*, each sampling switch SW1 may be simultaneously turned on during a sampling period Ts in response to an SW1 control signal (a first sampling control signal), and thus, may sample a sensing voltage Vin supplied through an input line from each sensing line SL of the panel 100 and may store the sampled sensing voltage in the sampling capacitor C1***in*. In the plurality of sensing-channel sample/hold circuits 310_1 to **310_*m*, the holding switch SW2 may be turned on in a holding/amplifying period Ta where sensing voltages are sequentially allocated to a plurality of sensing channels, in response to an SW2 control signal (a first holding control signal) applied differently for each sensing channel, and may sequentially transfer a sensing voltage, stored in each sampling capacitor C1 in, to the first input terminal (+) of the amplification part 320**.

Each of the plurality of sensing-channel sample/hold circuits 310_1 to **310_*m* may further include an off switch SWoff connected between the ground terminal and a second input terminal (−) of the amplification part 320. The off switch SWoff may be provided for each channel, for symmetricity between the number of switches connected to the first input terminal (+) of the amplification part 320** and the number of switches connected to the second input terminal (−) (i.e., for symmetricity of a parasitic capacitor), and may always maintain a turn-off state.

The share-channel sample/hold circuit DMY may include a sampling switch SW8 and a holding switch SW7, connected serially between a supply line for the reference voltage Vb and the second input terminal (−) of the amplification part 320, and a sampling capacitor C2*in* connected between the ground terminal and a connection node between the sampling switch SW8 and the holding switch SW7. The share-channel sample/hold circuit DMY may further include an off switch SWoff having a turn-off state connected between the ground terminal and the first input terminal (+) of the amplification part 320, for symmetricity of a switch connected to the first input terminal (+) and the second input terminal (−) of the amplification part 320.

In the share-channel sample/hold circuit DMY, the sampling switch SW8 may be turned on at every partial portion (latter portion) of the sampling period Ts and reset period Tr of the amplification part 320 in response to an SW8 control signal (a second sampling control signal), and moreover, may sample the reference voltage Vb and may store the sampled reference voltage in the sampling capacitor C2*in*. In the share-channel sample/hold circuit DMY, the holding switch SW7 may be turned on at every holding/amplifying period Ta of each sensing channel in response to an SW7 control signal (a second holding control signal), and may transfer the reference voltage, stored in the sampling capacitor C2*in*, to the second input terminal (−) of the amplification part 320.

Therefore, in each holding/amplifying period Ta allocated to each of the plurality of sensing channels, the sample/hold circuit part 310 may provide the first and second input terminals (+, −) of the amplification part 320 with a sensing voltage stored in the sampling capacitor C1*in* of a corresponding sensing channel and a reference voltage stored in the sampling capacitor C2*in* of a share channel in a differential input structure and may include the m+1 sample/hold circuits 310_1 to **310_*m*** and DMY, thereby decreasing a circuit configuration and a circuit area.

The plurality of sensing-channel sample/hold circuits 310_1 to **310_*m* and the share-channel sample/hold circuit DMY of the sample/hold circuit part 310 may share one amplification part 320. In each holding/amplifying period Ta allocated to each of the plurality of sensing channels, the amplification part 320 may perform an amplification operation of differential-amplifying the sensing voltage and the reference voltage provided to the first and second input terminals (+, −) to output a first output voltage VOUT_N and a second output voltage VOUT_P in a differential structure therebetween and may perform a reset operation of resetting the amplification part 320** before each amplifying period Ta.

The amplification part 320 may include a differential amplifier AMP including two input terminals (+, −) and two output terminals (−, +), a first feedback capacitor C1*fb* and a first feedback switch SW5*a* connected serially between a first input terminal (+) of the amplifier AMP and a second output terminal (−) having an opposite polarity thereof, a second feedback capacitor C2*fb* and a second feedback switch SW5*b* connected serially between a second input terminal (−) of the amplifier AMP and a first output terminal (+) having an opposite polarity thereof, input reset switches SW3*a* and SW3*b* connected between each of the input terminals (+, −) of the amplifier AMP and a reference voltage Vb supply line, a reset switch SW4 connected between the first and second output terminals (−, +) of the amplifier AMP, a first feedback reset switch SW6*a* connected between a connection node between the first feedback capacitor C1*fb* and the first feedback switch SW5*a* and a supply line for an ADC maximum voltage Vt, and a second feedback reset switch SW6*b* connected between a connection node between the second feedback capacitor C2*fb* and the second feedback switch SW5*b* and a supply line for the reference voltage Vb.

The amplification part 320 may alternately and repeatedly perform a reset operation of each reset period Tr in response to an SW3 control signal (a first reset control signal), an SW4 control signal (a second reset control signal), and an SW6 control signal (a third reset control signal) and an amplification operation of each holding/amplifying period Ta in response to an SW5 control signal (an amplification control signal).

The input reset switches SW3*a* and SW3*b* may be turned on in response to the SW3 control signal (the first reset control signal), the output reset switch SW4 may be turned on in response to the SW4 control signal (the second reset control signal), and the feedback reset switches SW6*a* and SW6*b* may be turned on in response to the SW6 control signal (the third reset control signal), and thus, the amplification part 320 may perform a reset operation.

In each holding/amplifying period Ta, the feedback switches SW5*a* and SW5*b* may be turned on by the SW5 control signal (the amplification control signal), and thus, the first feedback capacitor C1*fb* may be connected between the first input terminal (+) and the second output terminal (−) and the second feedback capacitor C2*fb* may be connected between the second input terminal (−) and the first output terminal (+), whereby the amplification part 320 may perform an amplification operation of differential-amplifying the sensing voltage provided to the first input terminal (+) and the reference voltage provided to the second input terminal (−) to output a differential signal between the first output voltage VOUT_N and the second output voltage VOUT_P.

The ADC 330 may convert a differential output of the first and second output voltages VOUT_N and VOUT_P, output from the amplification part 320, into digital sensing data ADC_code and may provide the digital sensing data ADC_code to the timing controller 400.

Referring to FIG. 4, the data driver 300 may generate the SW1 to SW8 control signals on the basis of a clock signal having a certain period.

For example, the SW1 control signal (the first sampling control signal) supplied to the sampling switch SW1 of each of the plurality of sensing channels 1CH to mCH in common may be put in an active state during a sampling period Ts corresponding to one period of the clock signal.

The SW2 control signal (the first holding control signal) individually supplied to the holding switch SW2 of each of the plurality of sensing channels 1CH to mCH may be sequentially put in an active state during a holding period (an amplifying period) Ta corresponding to ½ period at every period of the clock signal.

The SW3 control signal (the first reset control signal) supplied to the input reset switches SW3*a* and SW3*b* of the amplification part 320 in common, the SW4 control signal (the second reset control signal) supplied to the output reset switch SW4, the SW6 control signal (the third reset control signal) supplied to the input reset switches SW6*a* and SW6*b* in common, and the SW8 control signal (the second sampling control signal) supplied to the sampling switch SW8 of the share channel DMY may have a phase opposite to a phase of the clock signal and the same period as that of the clock signal and may be simultaneously put in an active state during a reset period Tr corresponding to ½ period at every period of the clock signal.

The SW5 control signal (the amplification control signal) supplied to the feedback switches SW5*a* and SW5*b* of the amplification part 320 in common and the SW7 control signal (the second holding control signal) supplied to the holding switch SW7 of the share channel DMY may have the same period and phase as those of the clock signal and may be simultaneously put in an active state during a holding/amplifying period Ta corresponding to ½ period at every period of the clock signal.

Figure 5:
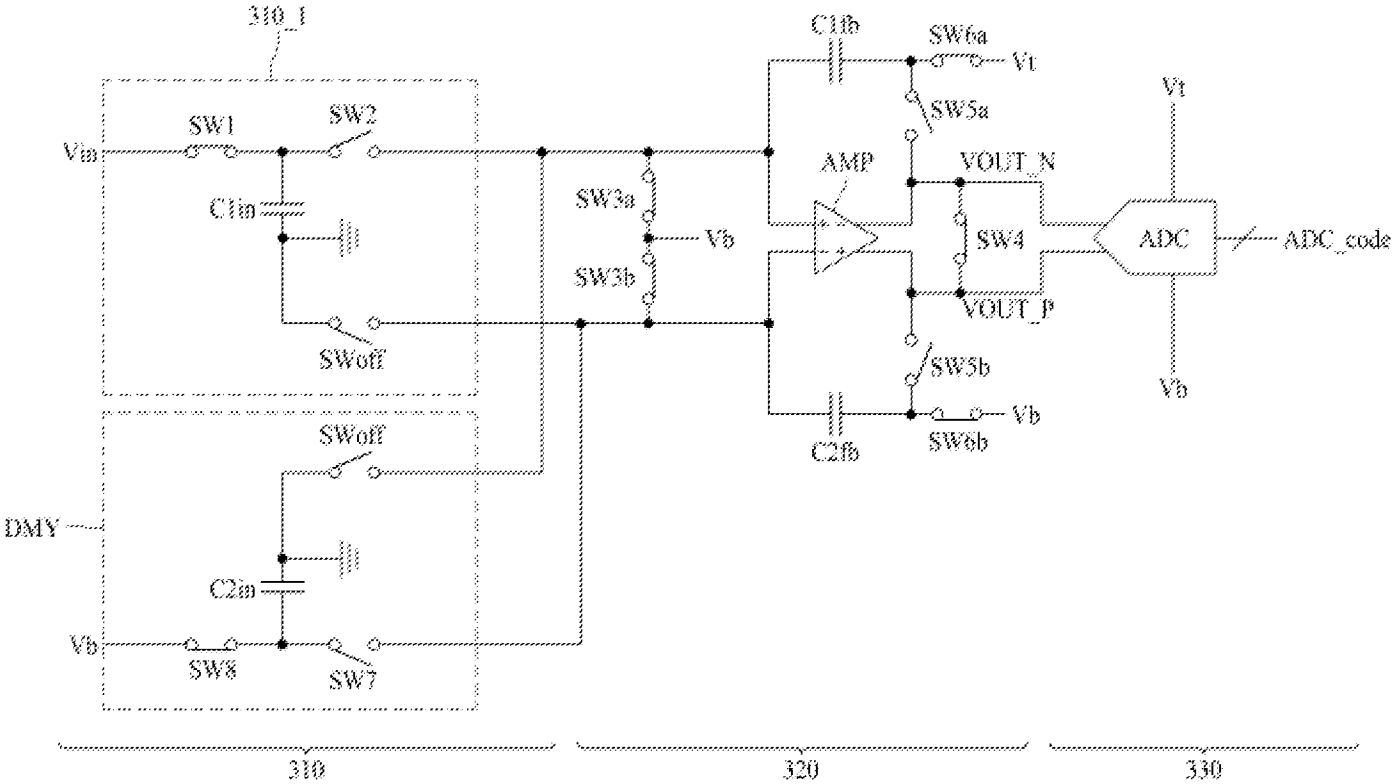
FIG. 5 is a circuit diagram illustrating an amplifier reset operation and a sampling operation of a multi-channel sensing circuit according to an embodiment illustrated in FIG. 3.
Figure 6:
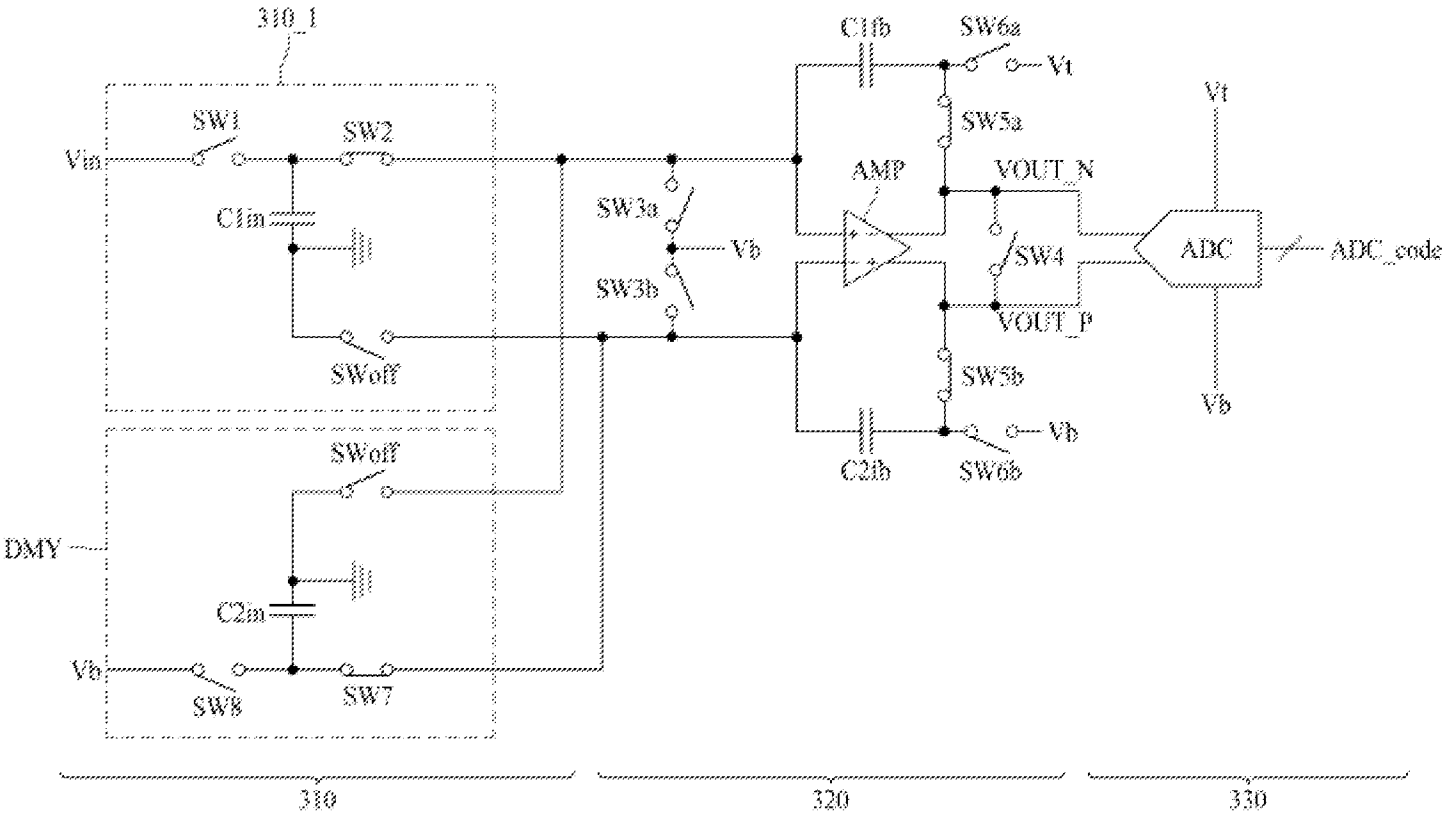
FIG. 6 is a circuit diagram illustrating a holding/amplifying operation of a multi-channel sensing circuit according to an embodiment illustrated in FIG. 3.
Figure 7:
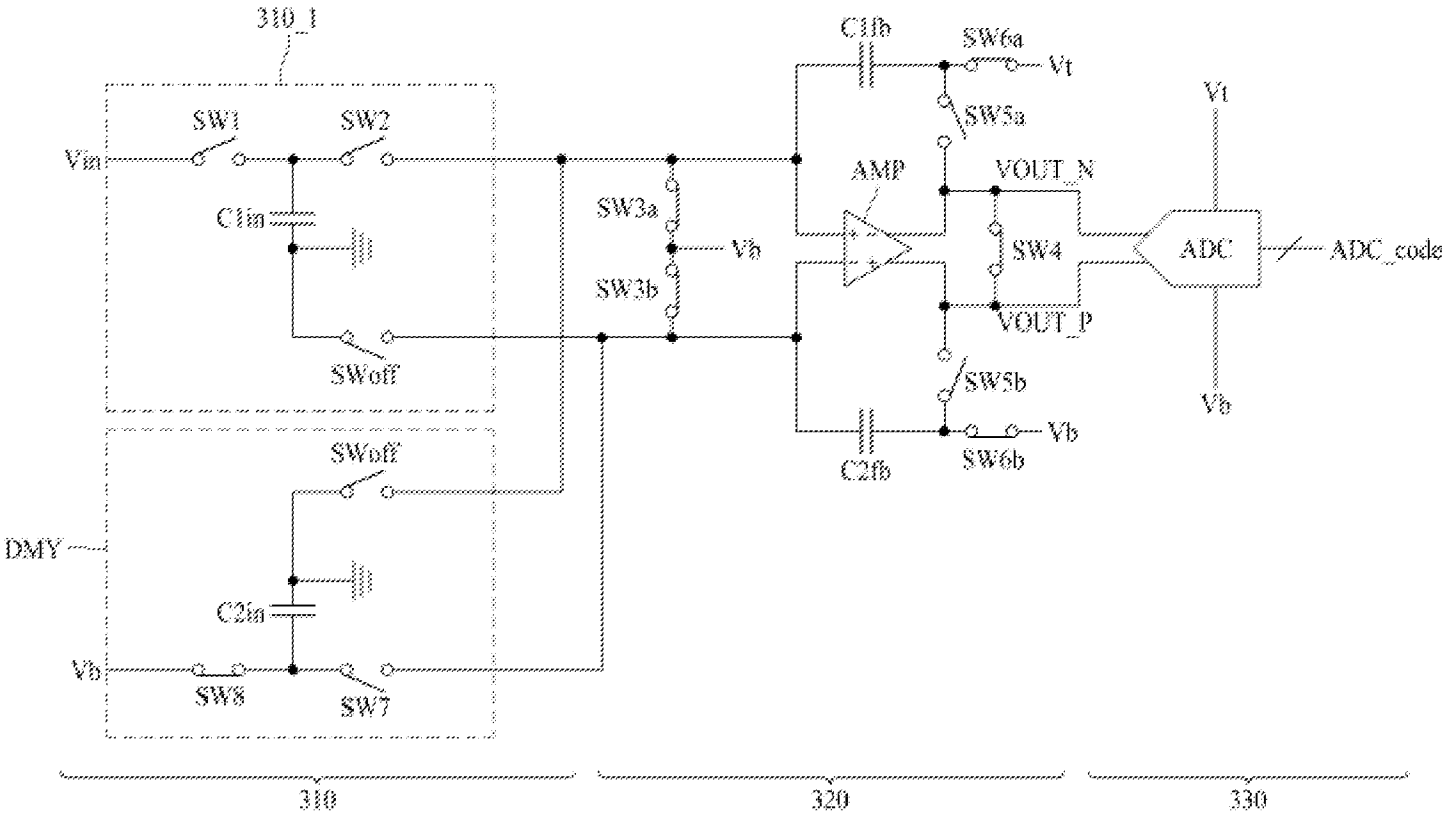
FIG. 7 is a circuit diagram illustrating an amplifier reset operation and a shared channel sampling operation of a multi-channel sensing circuit according to an embodiment illustrated in FIG. 3.

FIG. 5 is a circuit diagram illustrating an amplifier reset operation and a sampling operation of the multi-channel sensing circuit according to an embodiment illustrated in FIG. 3, FIG. 6 is a circuit diagram illustrating a holding/amplifying operation of the multi-channel sensing circuit according to an embodiment illustrated in FIG. 3, and FIG. 7 is a circuit diagram illustrating an amplifier reset operation and a shared channel sampling operation of the multi-channel sensing circuit according to an embodiment illustrated in FIG. 3.

An operation of the multi-channel sensing circuit according to an embodiment illustrated in FIG. 3 will be described below in detail with reference to FIGS. 4 to 7. In FIGS. 5 to 7, for convenience of description, only an operation of a sample/hold circuit 310_1 of a first sensing channel among a plurality of sensing channels is shown.

Referring to FIGS. 4 to 5, during the sampling period Ts, the sampling switches SW1 of the plurality of sensing channels 310_1 to 310_*m* may be simultaneously turned on in response to the SW1 control signal (the first sampling control signal), and thus, may sample the sensing voltage Vin supplied through each input line from each sensing line SL of the panel 100 and may store the sampled sensing voltage in each sampling capacitor C1*in*.

During a latter portion of the sampling period Ts and the reset period Tr subsequent thereto, the sampling switch SW8 of the share channel DMY may be turned on in response to the SW8 control signal (the second sampling control signal), and thus, may sample the reference voltage Vb supplied thereto and may store the sampled reference voltage in the sampling capacitor C2*in*. Simultaneously, in response to the SW3, SW4, and SW6 control signals (the first, second, and third reset control signals), the input reset switches SW3*a* and SW3*b*, the output reset switch SW4, and the feedback reset switches SW6*a* and SW6*b* of the amplification part 320 may be turned on, and thus, the amplification part 320 may perform a reset operation.

Referring to FIGS. 4 and 6, during a holding/amplifying period Ta1 of a first sensing channel, in response to the SW2 and SW7 control signals (the first and second holding control signals), the holding switch SW2 of the first sensing channel 310_1 may provide the first input terminal (+) of the amplification part 320 with the sensing voltage stored in the sampling capacitor C1*in*, and the holding switch SW7 of the share channel DMY may provide the second input terminal (−) of the amplification part 320 with the reference voltage stored in the sampling capacitor C2*in*. Simultaneously, the feedback switches SW5*a* and SW5*b* may be turned on in response to the SW5 control signal (the amplification control signal), and thus, the amplification part 320 may perform an amplification operation of differential-amplifying the sensing voltage of the first sensing channel and the reference voltage of the share channel provided to the first and second input terminals (+, −) to output the first output voltage VOUT_N and the second output voltage VOUT_P in a differential structure therebetween. At this time, the ADC 330 may convert a differential output of the first and second output voltages VOUT_N and VOUT_P, which are output from the amplification part 320 and correspond to the first sensing channel, into the digital sensing data ADC_code and may provide the digital sensing data ADC_code to the timing controller 400.

Referring to FIGS. 4 and 7, during the reset period Tr subsequent to the holding/amplifying period Ta1 of the first sensing channel, in response to the SW8 control signal (the second sampling control signal), the sampling switch SW8 of the share channel DMY may sample the reference voltage Vb and may store the sampled reference voltage in the sampling capacitor C2*in*, and in response to the SW3, SW4, and SW6 control signals (the first, second, and third reset control signals), the input reset switches SW3*a* and SW3*b*, the output reset switch SW4, and the feedback reset switches SW6*a* and SW6*b* of the amplification part 320 may perform a reset operation.

Referring to FIGS. 3 and 4, during a holding/amplifying period Ta2 of a second sensing channel, in response to the SW2 and SW7 control signals (the first and second holding control signals), the holding switch SW2 of the second sensing channel 310_2 may provide the first input terminal (+) of the amplification part 320 with the sensing voltage stored in the sampling capacitor C1*in*, and the holding switch SW7 of the share channel DMY may provide the second input terminal (−) of the amplification part 320 with the reference voltage stored in the sampling capacitor C2*in*. Simultaneously, the feedback switches SW5*a* and SW5*b* may be turned on in response to the SW5 control signal (the amplification control signal), and thus, the amplification part 320 may perform an amplification operation of differential-amplifying the sensing voltage of the second sensing channel and the reference voltage of the share channel provided to the first and second input terminals (+, −) to output the first output voltage VOUT_N and the second output voltage VOUT_P in a differential structure therebetween. At this time, the ADC 330 may convert a differential output of the first and second output voltages VOUT_N and VOUT_P, output from the amplification part 320, which are output from the amplification part 320 and correspond to the second sensing channel, into the digital sensing data ADC_code and may provide the digital sensing data ADC_code to the timing controller 400.

As described above, after a sampling operation of each of the plurality of sensing channels 310_1 to 310_*m* in the sampling period Ts, the multi-channel sensing circuit according to an embodiment illustrated in FIG. 3 may alternately and repeatedly perform a reset operation of the amplification part 320 and a sampling operation of the share channel DMY in each reset period Tr and a holding/amplifying operation of each of a corresponding sensing channel and share channel and the amplification part 320 in holding/amplifying periods Ta1, Ta2, . . . , and Ta(m) sequentially allocated to the plurality of sensing channels, and thus, may sequentially convert sensing voltages of a plurality of channels into the digital sensing data ADC_code and may output the digital sensing data ADC_code.

As described above, the multi-channel sensing circuit according to an embodiment may provide a differential input structure to the amplification part 320, and moreover, comparing with a configuration of 2 m number of S/H circuits of the related art where a pair of S/H circuits are provided for each channel, the multi-channel sensing circuit according to an embodiment may include m+1 number of S/H circuits, thereby decreasing the number of S/H circuits. Accordingly, in the multi-channel sensing circuit according to an embodiment, a circuit configuration and area of the S/H circuit part 310 occupying the most of an area of the multi-channel sensing circuit may be reduced, and thus, a circuit configuration and area of the data driver 300 may decrease, thereby reducing the manufacturing cost.

As described above, in the multi-channel sensing circuit and the sensing method thereof according to an embodiment, a single-structure sample/hold circuit of each of a plurality of sensing channels and a single-structure sample/hold circuit of a share channel may be connected to an amplifier in a differential structure, and thus, a circuit configuration and area of a sample/hold circuit part occupying the most of an area of the multi-channel sensing circuit may be reduced.

Therefore, in the multi-channel sensing circuit and the sensing method thereof according to an embodiment, because a circuit configuration and area of the multi-channel sensing circuit are reduced, a circuit configuration and area of a driver may decrease, thereby reducing the manufacturing cost of a driver circuit.

The data driver with the multi-channel sensing circuit according to the embodiment may be applied to various electronic devices. For example, the data driver with the multi-channel sensing circuit according to the embodiment may be applied to a mobile device, a video phone, a smart watch, a watch phone, a wearable device, a foldable device, a rollable device, a bendable device, a flexible device, a curved device, an electronic notebook, an e-book, a portable multimedia player (PMP), a personal digital assistant (PDA), an MPEG audio layer-3 player, a mobile medical device, a desktop personal computer (PC), a laptop PC, a netbook computer, a workstation, a navigation device, a vehicle navigation device, a vehicle display device, a television, a wallpaper display device, a signage device, a game device, a notebook computer, a monitor, a camera, a camcorder, a home appliance, and the like.

Features, structures, effects, etc. described above in various examples of the present disclosure are included in at least one example of the present disclosure and are not necessarily limited to only one example. Furthermore, features, structures, effects, etc. illustrated in at least one example of the present disclosure may be combined or modified for other examples by those skilled in the art to which the technical idea of the present disclosure pertains. Therefore, the contents related to such combinations and modifications should be interpreted as being included in the technical spirit or scope of the present disclosure.

While the present disclosure described above is not limited to the above-described embodiments and the accompanying drawings, it will be apparent to those skilled in the art to which the present disclosure belongs that various substitutions, modifications, and changes may be made herein without departing from the scope of the present disclosure. Therefore, the scope of the present disclosure is defined by the appended claims, and all changes or modifications derived from the meaning, scope, and equivalence of the claims are to be construed as being included in the scope of the present disclosure.

What is claimed is:

1. A multi-channel sensing circuit comprising:

a first sample/hold circuit sampling and outputting a first sensing voltage obtained by sensing a driving characteristic of a pixel connected to a first sensing channel;

a second sample/hold circuit sampling and outputting a second sensing voltage obtained by sensing a driving characteristic of a pixel connected to a second sensing channel;

a share sample/hold circuit sampling and outputting a reference voltage; and an amplification part differential-amplifying the first sensing voltage output from the first sample/hold circuit and the reference voltage output from the share sample/hold circuit, and differential-amplifying the second sensing voltage output from the second sample/hold circuit and the reference voltage output from the share sample/hold circuit, wherein, during a sampling period, the first sample/hold circuit samples the first sensing voltage and the second sample/hold circuit samples the second sensing voltage, during a first reset period after the sampling period, the share sample/hold circuit samples the reference voltage, during a first holding/amplifying period after the first reset period, the first sample/hold circuit outputs the first sensing voltage to the amplification part, during a second reset period after the first holding/amplifying period, the share sample/hold circuit outputs the reference voltage, during a second holding/amplifying period after the second reset period, the second sample/hold circuit outputs the second sensing voltage to the amplification part, and the share sample/hold circuit outputs the reference voltage to the amplification part during the first and second holding/amplifying periods.

2. The multi-channel sensing circuit of claim 1, wherein the amplification part comprises:

a first input terminal connected to the first and second sample/hold circuits; and a second input terminal connected to the share sample/hold circuit.

3. The multi-channel sensing circuit of claim 1, wherein an input terminal and an output terminal of the amplification part, and a feedback capacitor connected between the input terminal and the output terminal, are reset during the first and second reset periods.

4. The multi-channel sensing circuit of claim 1, wherein there is a reset period overlapping the sampling period.

5. The multi-channel sensing circuit of claim 1, wherein each of the first and second reset periods is set to be equal to each of the first and second holding/amplifying periods, and the sampling period is set to be longer than each of the first and second reset periods and each of the first and second holding/amplifying periods.

6. The multi-channel sensing circuit of claim 1, wherein each of the first and second sample/hold circuits comprises:

a first sampling switch turned on during a sampling period to sample a sensing voltage obtained in each sensing channel;

a first sampling capacitor storing a sampled sensing voltage; and a first holding switch turned on during a holding/amplifying period set for each corresponding sample/hold circuit to output the sensing voltage, stored in the first sampling capacitor, to the amplification part.

7. The multi-channel sensing circuit of claim 6, wherein each of the first and second sample/hold circuits further comprises a first off switch connected between a ground terminal connected to the first sampling capacitor and a second input terminal of the amplification part to maintain a turn-off state.

8. The multi-channel sensing circuit of claim 1, wherein the share sample/hold circuit comprises:

a second sampling switch turned on during a reset period to sample the reference voltage;

a second sampling capacitor storing a sampled reference voltage; and a second holding switch turned on during a holding/amplifying period to output the reference voltage, stored in the second sampling capacitor, to the amplification part.

9. The multi-channel sensing circuit of claim 8, wherein the share sample/hold circuit further comprises a second off switch connected between the ground terminal connected to the second sampling capacitor and a first input terminal of the amplification part to maintain a turn-off state.

10. The multi-channel sensing circuit of claim 8, wherein the amplification part comprises:

an amplifier differential-amplifying a corresponding sensing voltage supplied to a first input terminal and the reference voltage supplied to a second input terminal to output a differential signal though a first output terminal and a second output terminal during a holding/amplifying period;

a first feedback switch connecting a first feedback capacitor to the first input terminal and the second output terminal having a polarity opposite thereto during the holding/amplifying period; and a second feedback switch connecting a second feedback capacitor to the second input terminal and the first output terminal having a polarity opposite thereto during the holding/amplifying period.

11. The multi-channel sensing circuit of claim 10, wherein the amplification part comprises:

a first input reset switch and a second input reset switch respectively supplying the reference voltage to the first and second input terminals of the amplifier during a reset period;

an output reset switch connecting the first output terminal to the second output terminal during the reset period;

a first feedback reset switch resetting a connection node between the first feedback capacitor and the first feedback switch to a bias voltage during the reset period; and a second feedback reset switch resetting a connection node between the second feedback capacitor and the second feedback switch to the reference voltage during the reset period.

12. The multi-channel sensing circuit of claim 11, wherein a first reset control signal for controlling the first and second input reset switches, a second reset control signal for controlling the output reset switch, a third reset control signal for controlling the first and second feedback reset switches, and a sampling control signal for controlling the second sampling switch are supplied in a clock pulse form having the same period and the same phase, and a holding control signal for controlling the second holding switch is supplied in a clock pulse form having the same period as the sampling control signal and a phase opposite to the sampling control signal.

13. The multi-channel sensing circuit of claim 1, further comprising an analog-to-digital converter converting an output, differential-amplified by the amplification part, into digital sensing data and outputting the digital sensing data.

14. A sensing method of a multi-channel sensing circuit, the sensing method comprising:

sampling and outputting a first sensing voltage obtained by sensing a driving characteristic of a pixel connected to a first sensing channel by using a first sample/hold circuit and sampling and outputting a second sensing voltage obtained by sensing a driving characteristic of a pixel connected to a second sensing channel by using a second sample/hold circuit, during a sampling period;

sampling and outputting a reference voltage by using a share sample/hold circuit during a first reset period;

differential-amplifying and outputting the first sensing voltage output from the first sample/hold circuit and the reference voltage output from the share sample/hold circuit by using an amplification part during a first holding/amplifying period;

sampling and outputting the reference voltage by using the share sample/hold circuit during a second reset period; and differential-amplifying and outputting the second sensing voltage output from the second sample/hold circuit and the reference voltage output from the share sample/hold circuit by using the amplification part during a second holding/amplifying period.

15. The sensing method of claim 14, further comprising converting an output of the amplification part into digital sensing data and outputting the digital sensing data by using an analog-to-digital converter during the first and second holding/amplifying periods.

16. The sensing method of claim 14, further comprising resetting an input terminal and an output terminal of the amplification part and a feedback capacitor connected between the input terminal and the output terminal during the first and second reset periods.

17. The sensing method of claim 16, wherein during a reset period which overlaps the sampling period, the share sample/hold circuit samples the reference voltage and the amplification part is reset.

18. A data driver comprising:

a data driving part driving data lines; and a multi-channel sensing circuit connected to sensing channels, wherein the multi-channel sensing circuit comprises:

a first sample/hold circuit sampling and outputting a first sensing voltage obtained by sensing a driving characteristic of a pixel connected to a first sensing channel;

a second sample/hold circuit sampling and outputting a second sensing voltage obtained by sensing a driving characteristic of a pixel connected to a second sensing channel;

a share sample/hold circuit sampling and outputting a reference voltage; and an amplification part differential-amplifying the first sensing voltage output from the first sample/hold circuit and the reference voltage output from the share sample/hold circuit and differential-amplifying the second sensing voltage output from the second sample/hold circuit and the reference voltage output from the share sample/hold circuit, wherein, during a sampling period, the first sample/hold circuit samples the first sensing voltage and the second sample/hold circuit samples the second sensing voltage, during a first reset period after the sampling period, the share sample/hold circuit samples the reference voltage, during a first holding/amplifying period after the first reset period, the first sample/hold circuit outputs the first sensing voltage to the amplification part, during a second reset period after the first holding/amplifying period, the share sample/hold circuit outputs the reference voltage, during a second holding/amplifying period after the second reset period, the second sample/hold circuit outputs the second sensing voltage to the amplification part, and the share sample/hold circuit outputs the reference voltage to the amplification part during the first and second holding/amplifying periods.

* * * * *